US010688746B2

(12) United States Patent
Perez et al.

(10) Patent No.: US 10,688,746 B2
(45) Date of Patent: Jun. 23, 2020

(54) ROSIN PRESS

(71) Applicant: Mosman Machinery Company, Inc., Nevada City, CA (US)

(72) Inventors: Angel Ramon Torrado Perez, Lakewood, CO (US); Dana Eliot Mosman, Boulder, CO (US); Donald Mosman, Nevada City, CA (US)

(73) Assignee: Mosman Machinery Company, Inc., Nevada City, CA (US)

( * ) Notice: Subject to any disclaimer, the term of this patent is extended or adjusted under 35 U.S.C. 154(b) by 223 days.

(21) Appl. No.: 15/852,739

(22) Filed: Dec. 22, 2017

(65) Prior Publication Data

US 2018/0178473 A1 Jun. 28, 2018

Related U.S. Application Data

(60) Provisional application No. 62/468,648, filed on Mar. 8, 2017, provisional application No. 62/438,295, filed on Dec. 22, 2016.

(51) Int. Cl.

| | |
|---|---|
| ***B30B 15/06*** | (2006.01) |
| ***B30B 9/06*** | (2006.01) |
| ***B30B 15/00*** | (2006.01) |
| ***B30B 15/04*** | (2006.01) |
| ***B30B 15/34*** | (2006.01) |

(52) U.S. Cl.

CPC ..... *B30B 9/06* (2013.01); *B30B 15/0058* (2013.01); *B30B 15/047* (2013.01); *B30B 15/064* (2013.01); *B30B 15/34* (2013.01)

(58) Field of Classification Search

CPC ..... B30B 9/06; B30B 15/047; B30B 15/064; B30B 15/0058; B30B 15/34; B30B 11/10; B30B 11/08; B30B 11/04; B30B 7/02

USPC ..... 100/315, 326, 135, 193, 195, 198, 223, 100/231, 233, 250, 269.2, 292

See application file for complete search history.

(56) References Cited

U.S. PATENT DOCUMENTS

| | | | | |
|---|---|---|---|---|
| 7,337,716 | B2 * | 3/2008 | Scheel | A47J 19/023 100/213 |
| 7,669,522 | B2 * | 3/2010 | Cohen | A47J 37/0611 99/349 |
| 7,921,770 | B2 * | 4/2011 | Hughes | A47J 43/286 100/110 |
| 2007/0272094 | A1 * | 11/2007 | Geise | B30B 9/321 100/292 |
| 2018/0008655 | A1 * | 1/2018 | Weikel | A61K 36/185 |
| 2018/0084818 | A1 * | 3/2018 | Wettlaufer | A23N 1/00 |

* cited by examiner

*Primary Examiner* — Jimmy T Nguyen
(74) *Attorney, Agent, or Firm* — Snell & Wilmer, L.L.C.; Russell T. Manning

(57) ABSTRACT

A device for compressing plant material to extract fluids/oils/rosin. The device is composed of a press and stand. The press is rotatively coupled to the stand such that a press bed of the press may move between a horizontal orientation and a vertical orientation. When disposed in the vertical orientation, fluids pressed out of the plant material may drip out of the device to a collection location.

10 Claims, 15 Drawing Sheets

ROSIN PRESS

CROSS REFERENCE

The present application claims the benefit of the filing dates of U.S. Provisional Application No. 62/438,295 having a filing date of Dec. 22, 2016 and U.S. Provisional Application No. 62/468,648 having a filing date of Mar. 8, 2017, the entire contents of both of which are incorporated herein by reference.

FIELD

The present disclosure is directed to a system and method of extracting components from plants. More specifically, the present disclosure is directed to a process that uses heat and pressure to extract oils and/or rosins from plant material.

BACKGROUND

Flowers, buds and leaves harvested from plants (e.g., plant material) are often used in oils, medicinals, aromatherapy, cuisine, perfumes, dyes, oils, toilet preparations, tinctures, distillation products and the like. Typically, the plant material is processed to extract desired components. In one extraction process, plant matter is compressed and heated to extract oils and/or rosin.

The extraction of oils or rosins during a compression process has previously been a labor intensive process. Typically, plant material is compressed between heated compression plates of a press. Extracts pressed out of the compressed plant material then accumulate on the compression plates of the press. Once the press is opened and the plant material is removed, the extracts must then be scraped from the surface of the press.

SUMMARY

Aspects of the presented inventions are directed to a press device that allows applying high compression pressures to plant material and allowing a majority of the extract (e.g., rosin) generated by the compression to drip out of the press device facilitating collection. One aspect is directed to press device having a press bed or press plates that rotates from a generally horizontal orientation to a generally vertical orientation. In this aspect, the press bed may initially be disposed in the horizontal orientation to allow for loading of the press bed with plant matter. Once loaded, the press may close the press plates to hold the material, rotate to a vertical position and apply additional compression and/or heat to extract materials from the plant material. Accordingly, any oils or rosin pressed out of the plant material may drip out of the vertical press bed for collection.

The configuration of the press may be varied. In one arrangement, the press is generally a C-shaped press where upper and lower plates of the press bed are connected to a C-shaped bracket. In other arrangements, the press is generally an H-shaped press. In one arrangement, the press has heated platens attached to one or both of the upper and lower plates. In a further arrangement, the press includes one or more intermediate platens disposed between the upper and lower platens. The use of an intermediate platen allows compressing additional material during a single pressing process.

In any arrangement, the press bed (e.g., defined by the plates) moves from a generally horizontal orientation to a generally vertical orientation to allow extract/rosin to drip out of the press bed free of contacting the structure supporting the plates of the press bed.

DETAILED DESCRIPTION

Reference will now be made to the accompanying drawings, which at least assist in illustrating the various pertinent features of the presented inventions. The following description is presented for purposes of illustration and description and is not intended to limit the inventions to the forms disclosed herein. Consequently, variations and modifications commensurate with the following teachings, and skill and knowledge of the relevant art, are within the scope of the presented inventions. The embodiments described herein are further intended to explain the best modes known of practicing the inventions and to enable others skilled in the art to utilize the inventions in such, or other embodiments and with various modifications required by the particular application(s) or use(s) of the presented inventions.

The present disclosure is directed to press devices that are utilized to remove materials such as oils or rosins (hereafter 'rosin') from plant material using compression and/or heated compression. The press devices are configured to receive plant material between compression plates and compress the plant material to extract rosin. In addition, the press devices are configured to rotate the compression plates from a generally horizontal position to a generally vertical position to allow extracted rosin to drip from the press device onto, for example, a collection plate.

Figure 1A:
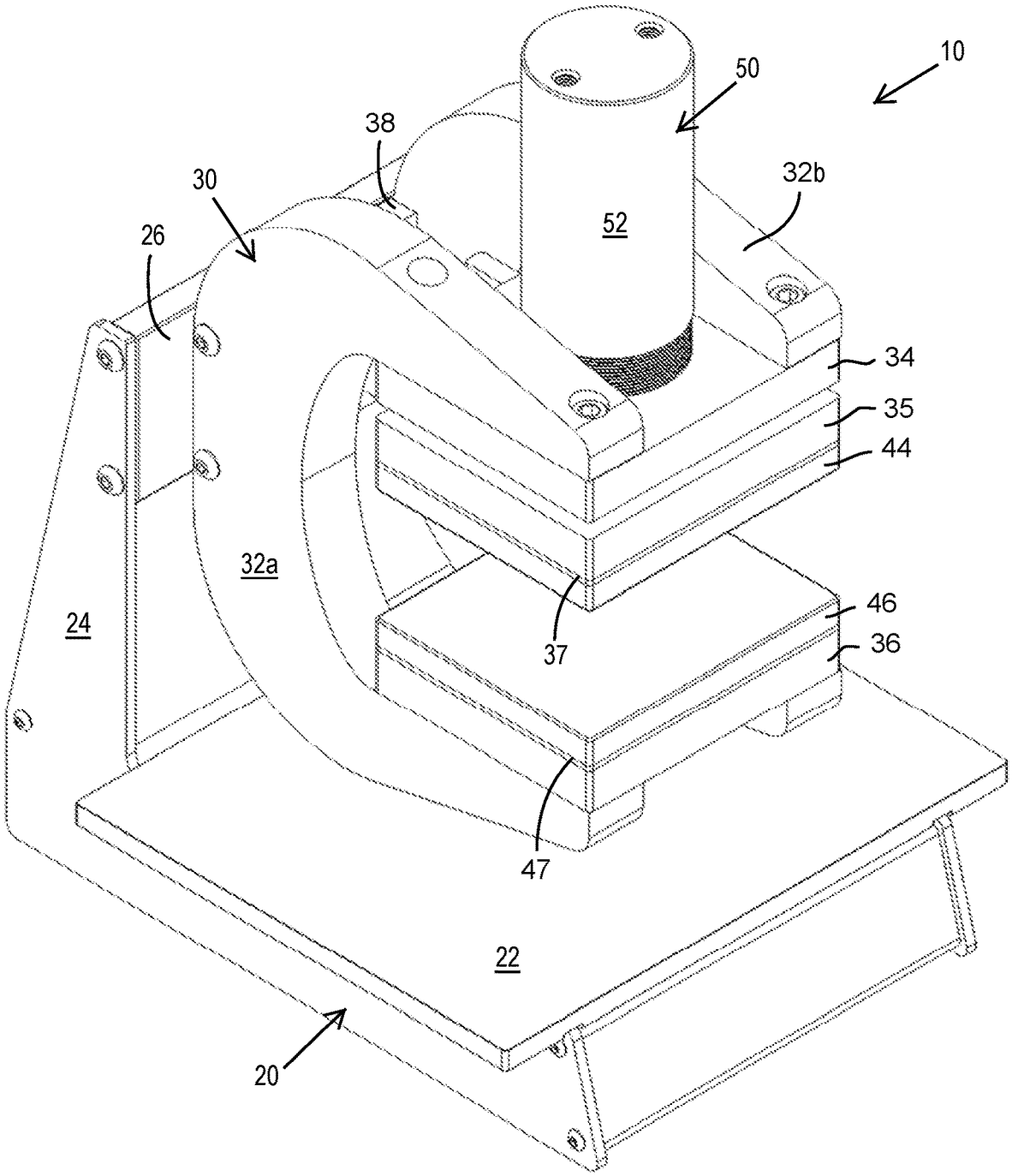
FIGS. 1A and 1B illustrate open and closed perspective views of one embodiment of a press device in a horizontal orientation.

A first embodiment of a press device 10 is illustrated in FIG. 1A. As shown, the device 10 is composed of two primary assemblies: a press 30 and a stand 20. The press 30 in the present embodiment is a C-press, which includes first and second C-shaped brackets 32*a*, 32*b* (hereafter 32 unless specifically referenced). Though the present embodiment discusses a C-configuration, it will be appreciated that aspects of the present disclosure are not so limited. That is, differently configured presses may be utilized. In the present embodiment, the brackets 32 are connected by an upper plate 34, which connects the upper jaws of the two C-shaped brackets 32, a lower plate 36, which connects the lower jaws of the two C-shaped brackets 32, and a rotational plate 38, which connects the closed ends (e.g., rearward end) of the C-shaped brackets. In the present embodiment, the plates 34-38 are bolted to the brackets 32 such the brackets are disposed in a spaced relationship. Other connection means are possible including, without limitation welding.

An actuator or ram 50 is fixedly connected to the upper plate 34 between the brackets 32. The ram 50 may be any actuator that is configured to move a movable plate relative to a stationary plate for the purpose of compressing material there between. In various embodiments the actuator may be electric, pneumatic, hydraulic and/or mechanical (e.g., a screw actuator). In the illustrated embodiment, the ram 50 is a hydraulic actuator that includes a cylinder 52 that is fluidly connected to a source of hydraulic fluid such as a pump (not shown). In the present embodiment, the cylinder 52 is threaded and is received in a threaded aperture in the upper plate 34 and secured with a set screw. Other connections are possible. A piston 54 of the ram 50, which moves relative to the cylinder 52 in conjunction with the insertion or removal of hydraulic fluid, connects to a piston plate or press plate 35. Upper and lower platens 44, 46 are attached to the press plate 35 and the lower plate 34, respectively. These platens 44, 46 may be heated and/or cooled as is more fully discussed in a further embodiment. In one embodiment, insulation plates 37, 47 may be disposed between the platens and their mating plate.

Figure 1B:
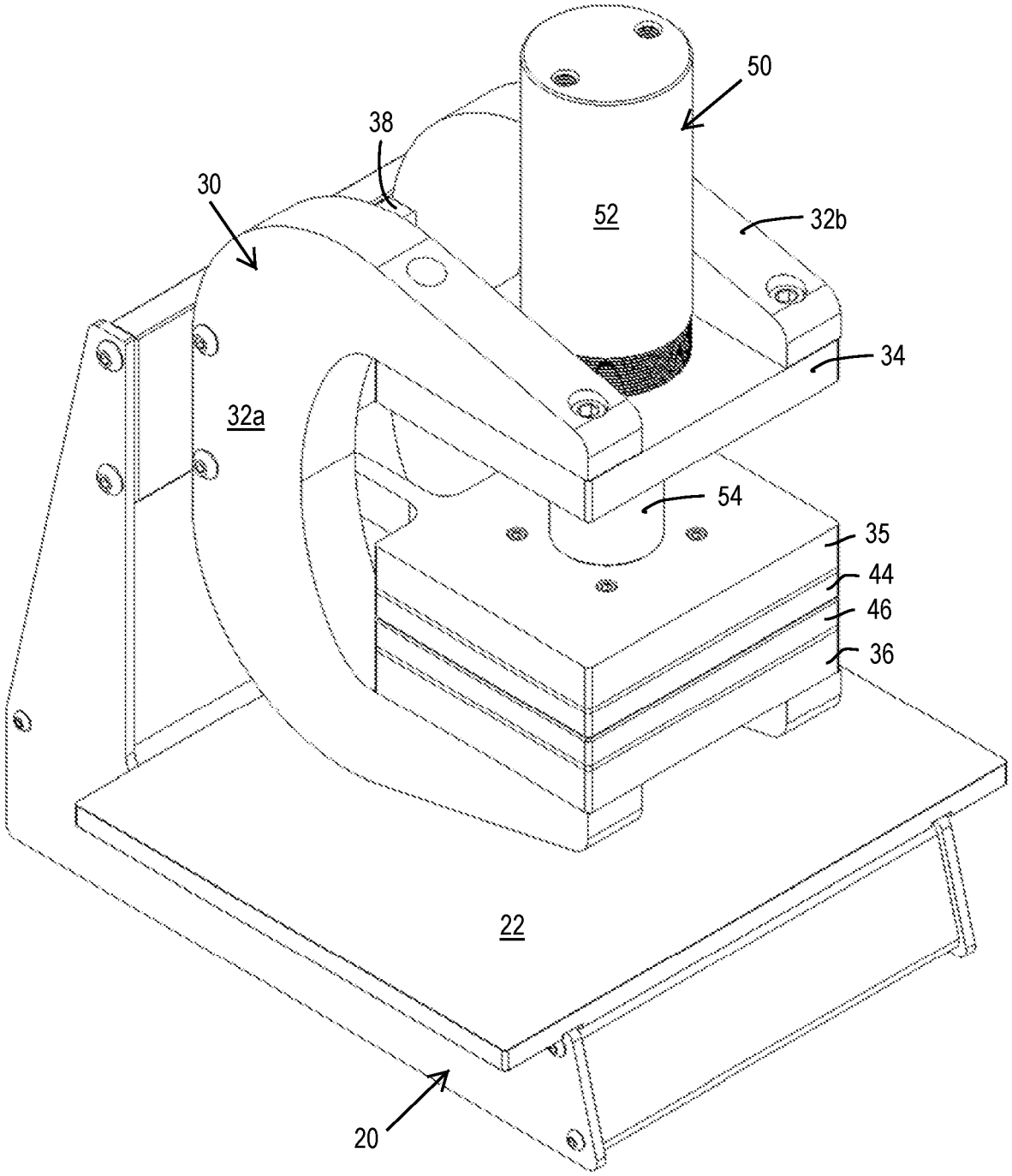

In operation, the piston 54 of the ram 50 extends such that the upper press plate 35 and platen 44 are advanced toward the lower platen 46 and lower plate 36 as illustrated in FIG. 1B. Accordingly, any material disposed between the platens may be compressed. Furthermore, it will be appreciated that various control functionality may be incorporated into the device 10 to control the compression pressure between the platens 44, 46. That is, the press 30 may apply a predetermined pressure between the platens 44, 46, which may be a function of the ram 50, the size of the platens 44, 46 and/or the area of material disposed between the platens 44, 46.

Figure 1C:
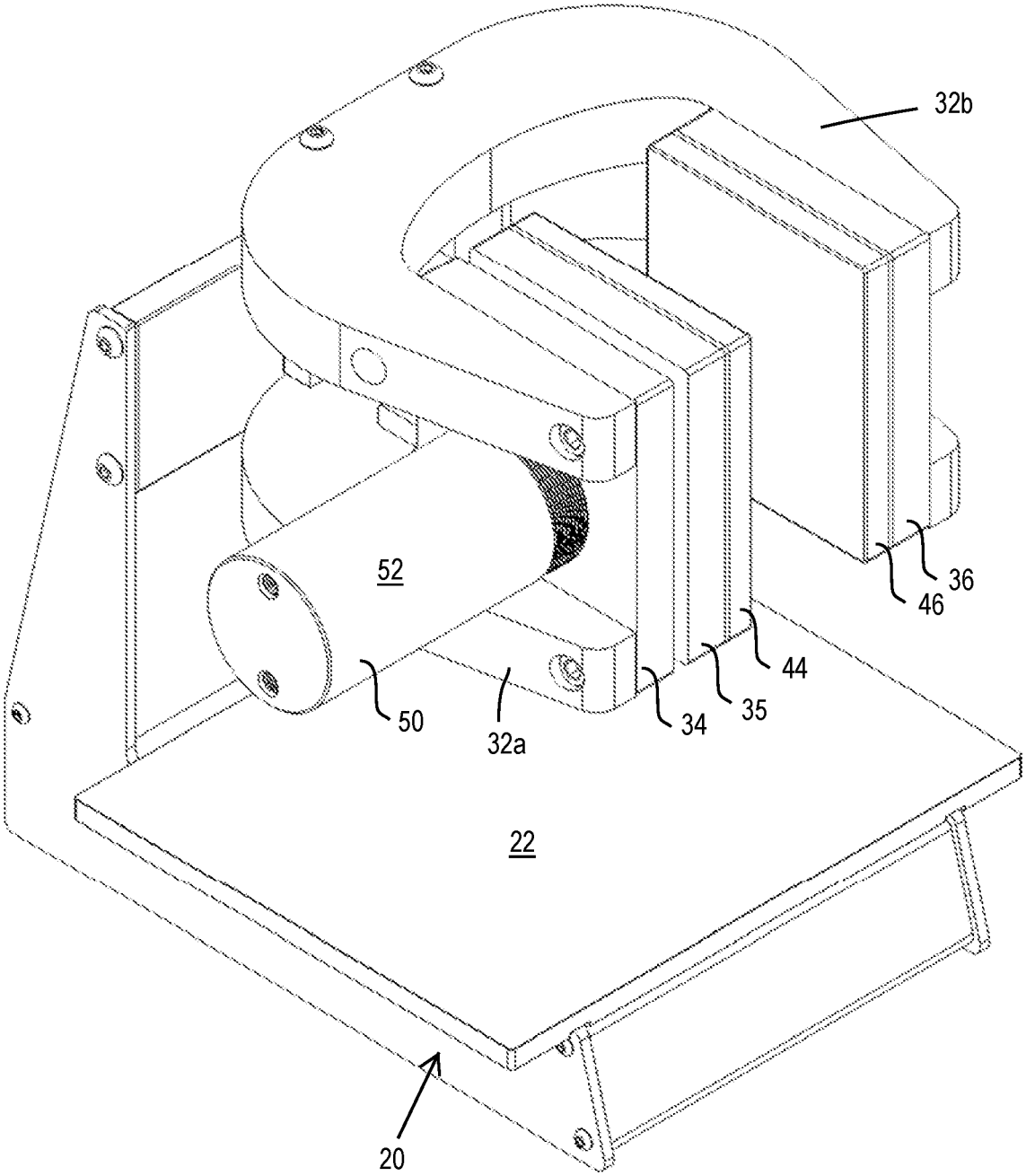
FIG. 1C illustrates a perspective view of the press device of in a vertical orientation.

In the present embodiment, the C-shaped brackets 32 are formed from thick metal plates such the brackets are able to withstand significant expansive forces applied between their upper and lower jaws without significant deformation. Of further note, the C-shaped brackets 32 have open sides, which allows rosin compressed out of plant material disposed between the compressed platens to drip out of the press when the press plates/platens are rotated into a vertical orientation. Along these lines, the press 30 is adapted to rotate relative to the stand 20 such that the upper and lower plates 35, 34 and upper and lower platens 44, 46 move from a generally horizontal orientation (e.g., FIGS. 1A, 1B) to a generally vertical orientation. See FIG. 1C. In such an orientation, any rosin or other fluid squeezed out of plant material (not shown) disposed between the compressed platens is squeezed out of the press 30 along the vertical interface between the upper and lower platens 44, 46. This rosin may then drip onto a collection plate 22 below the press 30. The collection plate, in the present embodiment, is removable from the stand 20 such that may be refrigerated prior to capturing any heated rosin that drips from the press. This allows rapidly cooling the rosin for collection. Alternatively, the plate 22 may be internally cooled. In any arrangement, the rosin or other fluid material compressed out of the plant material may be conveniently collected from the plate 22

Operation of the device 10 to extract plant rosin includes the following steps. Plant material is typically prepressed with a mold kit (not shown) prior to disposal between the platens of the device. Generally, loose plant material is compacted into a puck of material that will later be compressed. The puck is typically wrapped in a layer of silk or nylon fabric or other similar material with a specific filtering mesh size, and the wrapped again into a plastic layer with no filtering properties that allow directioning of the rosin flow. For instance, the plastic layer may, in one embodiment, be formed from a plastic a bag having three closed edges and one open edge. When the puck is compressed within the bag, rosin is directed out of the open edge (e.g., escape side) of the bag. Accordingly, the escape side of the bag may be positioned within the press such that it faces downward when the press is rotated into the vertical position. Similar directioning may be achieved utilizing an appropriately wrapped plastic sheet. In any arrangement, the puck is positioned between the platens 44, 48 of the press 30, with the escape side facing in the direction that will be rotated downward when the press is rotated. Typically, the platens are pre-heated to a desired temperature, though this is not a strict requirement. The platens are closed together hold the puck in position. The press is then tilted 90° and the remainder of the pressing operation may be performed. That is, the plates/platens are compressed to a desired pressure to expel liquefied rosin from the plant material. The liquid falls into the collection plate, which may by previously cooled or may be actively cooled to at least partially congeal the liquid.

Figure 2A:
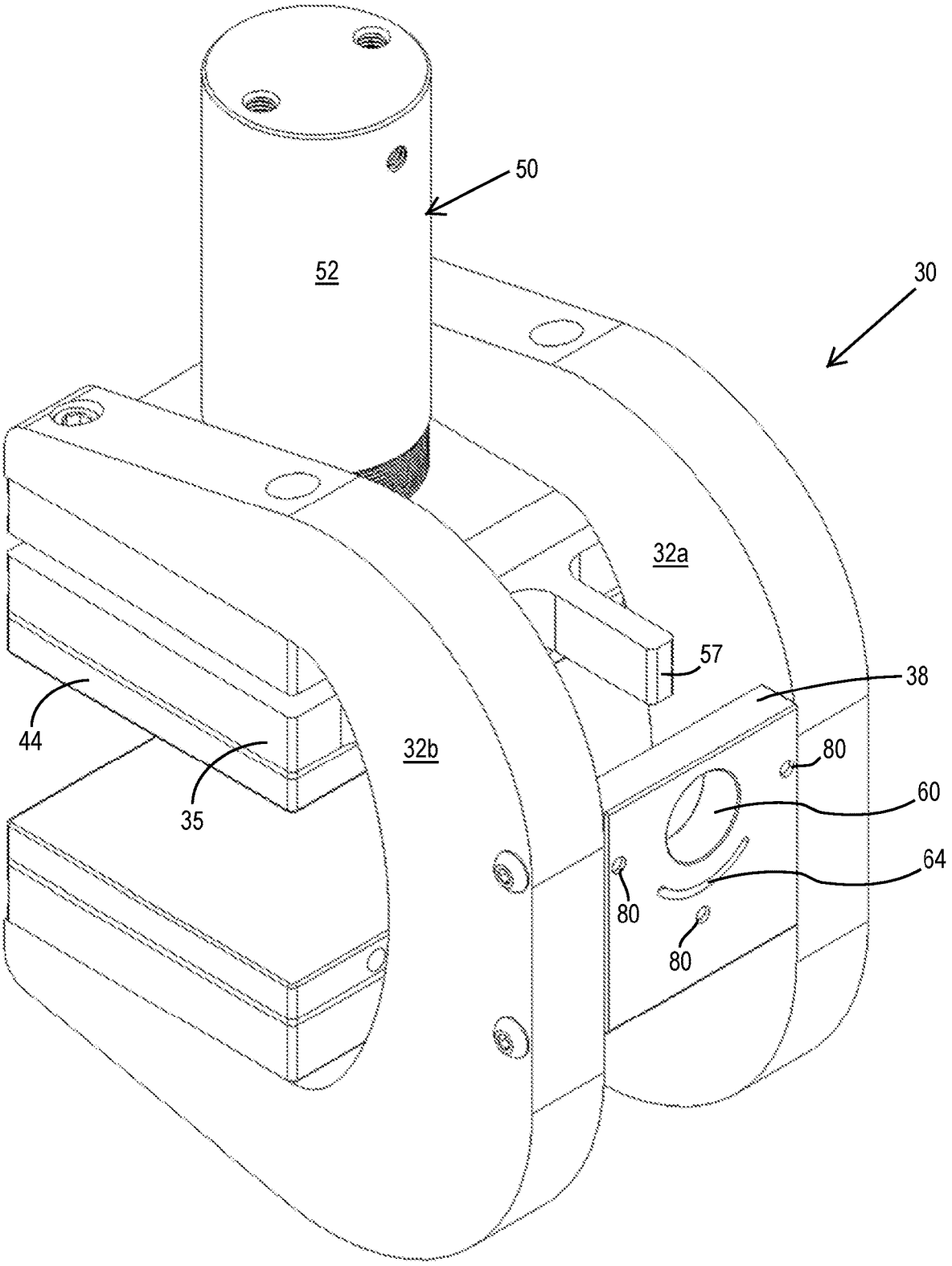
FIG. 2A illustrates a rear perspective view of one embodiment of the press device of FIG. 1A.
Figure 2B:
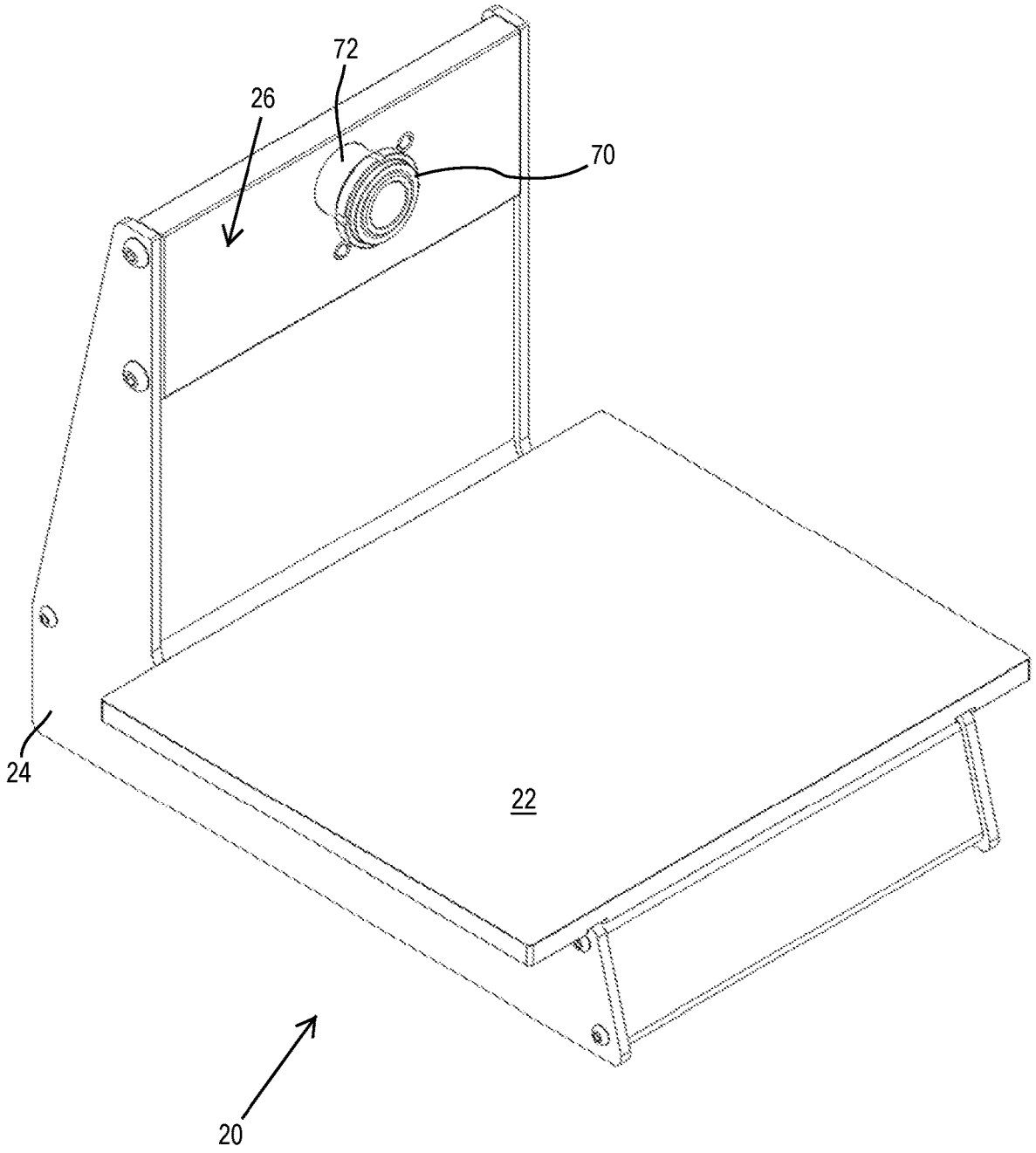
FIG. 2B illustrates a front perspective view of one embodiment of a stand.

FIG. 2A illustrates a rear perspective view of the press 10. This view illustrates rearward tabs 57 (only one shown) attached to the rearward edge of the piston plate 35. These tabs 57 ride between the inside or facing surfaces of the two C-brackets 32. These tabs 57 prevent rotation of the piston plate 35 and supported platen 44 as the piston moves the piston plate and platen towards the lower platen and lower plate. This view also shows the rotational plate 38, which is connected between the C-brackets 32. As shown, the rotational plate 38 includes an aperture or journal 60 that receives a bearing 72 attached to the stand 20. See FIG. 2B. In the present embodiment, the bearing 70 is fixedly connected to a plate 26 of the frame 24 of the stand 20. Together, the journal and bearing form a movable coupling/rotary coupling that supports/suspends the press relative to the stand. In the illustrated embodiment, the bearing 72 further includes a lock nut 70, which connects to threads on the outside of the bearing 72 once it is disposed through the rotational plate, as best shown in the cross-sectional view of FIG. 3A. The lock nut 70 secures the press to the stand and controls the friction between these components during rotation. In the present embodiment, the bearing 70 is hollow to allow various sensor wires, platen heater connections etc. to be routed through the bearing to the C-shaped press.

Figure 3A:
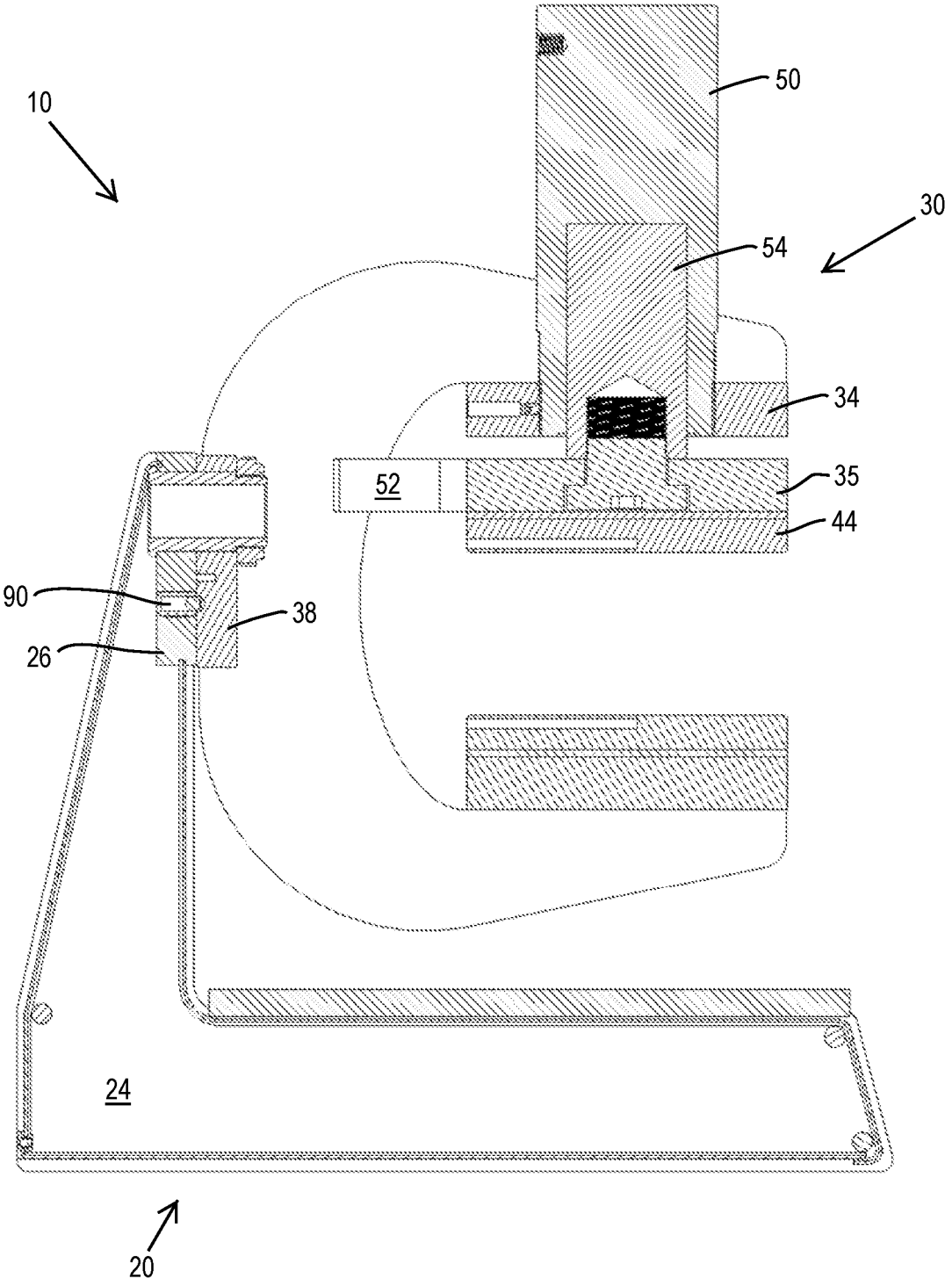
FIG. 3A illustrates a side cross-sectional view of the press device of FIG. 1A.
Figure 3B:
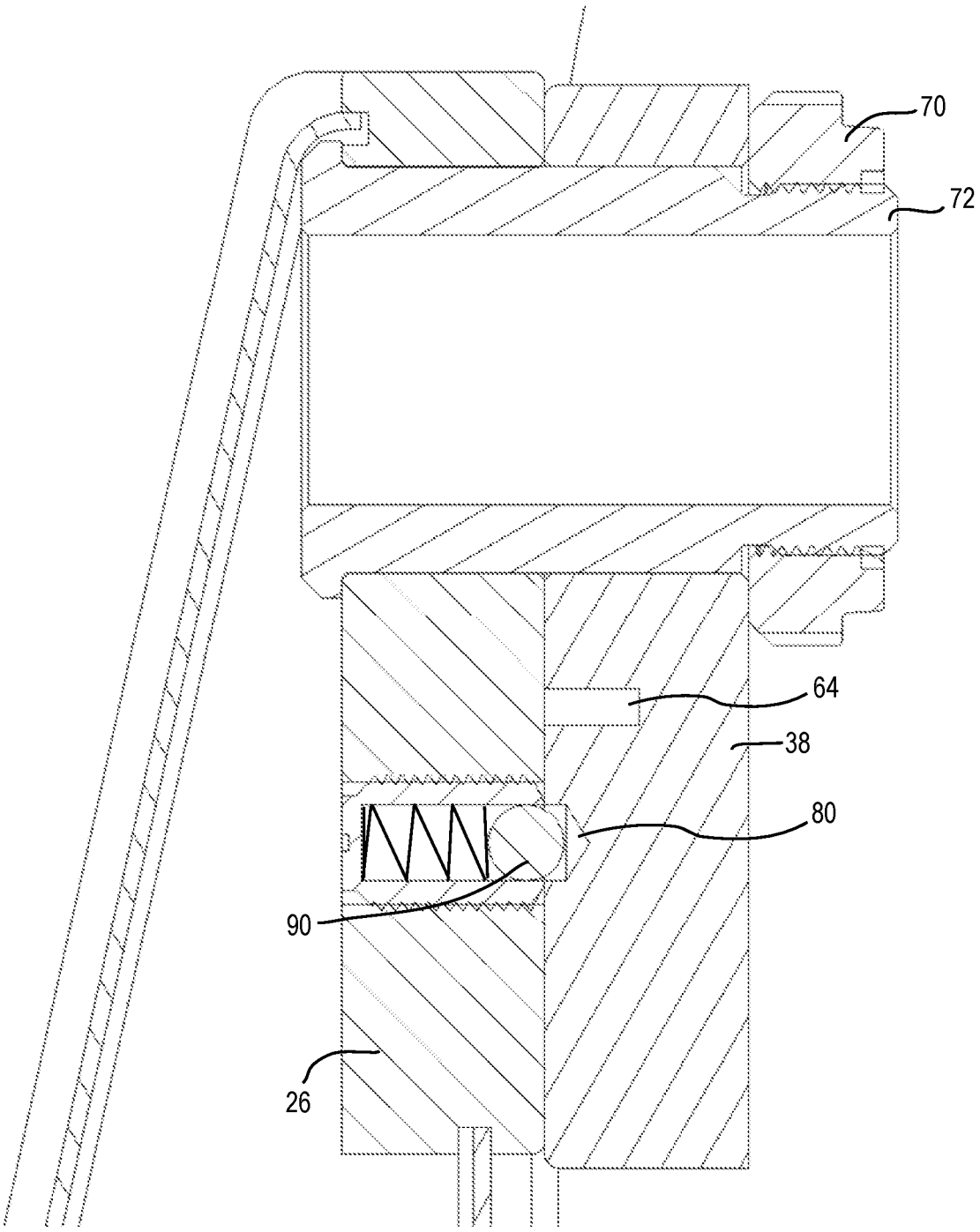
FIG. 3B illustrates a side cross-sectional view of an exemplary rotation mechanism of the device.

Referring again to FIG. 2A, the rotational plate 38 further includes an arcuate guide slot 64. As shown in FIGS. 3A and 3B, the guide slot 64 receives a pin (not shown) attached to the plate 26 of the stand 20. The pin moves along the arcuate guide slot 64 and limits the movement of the press to 90 degrees. That is, the ends of the guide slot 64 limit the movement of the pin. Once the pin reaches an end of the guide slot 64, further rotation of the press 30 is prevented. In the present embodiment, the rotational plate 38 further includes three detents 80. These detents 80 may be engaged by one or more spring plungers 90 (e.g., spring and ball bearing) attached to the stand. See FIG. 3B. These spring plungers help lock the press in a desired position (e.g., horizontal or vertical).

Figure 4A:
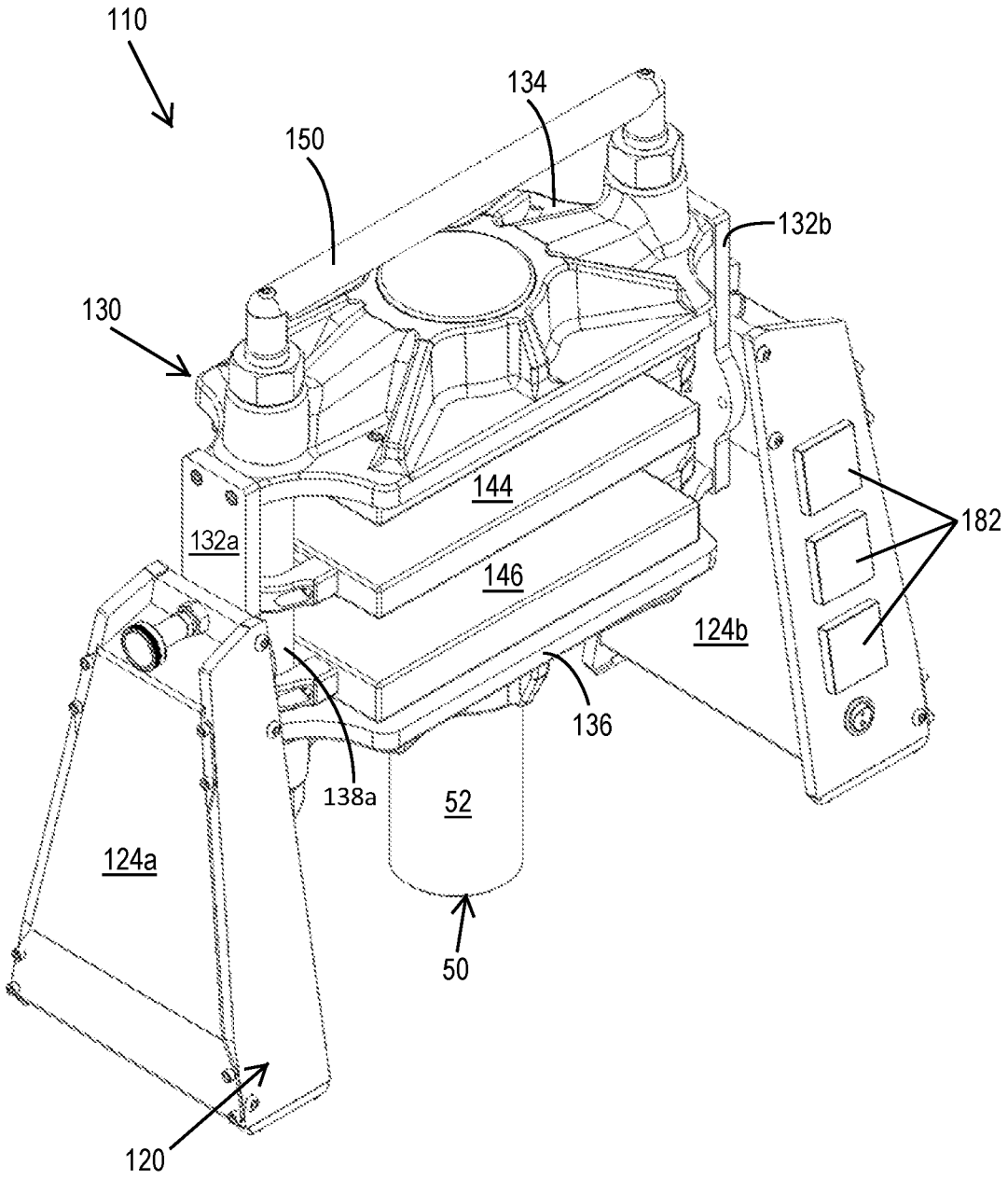
FIG. 4A illustrates a perspective view of another embodiment of a device in a vertical orientation.
Figure 4B:
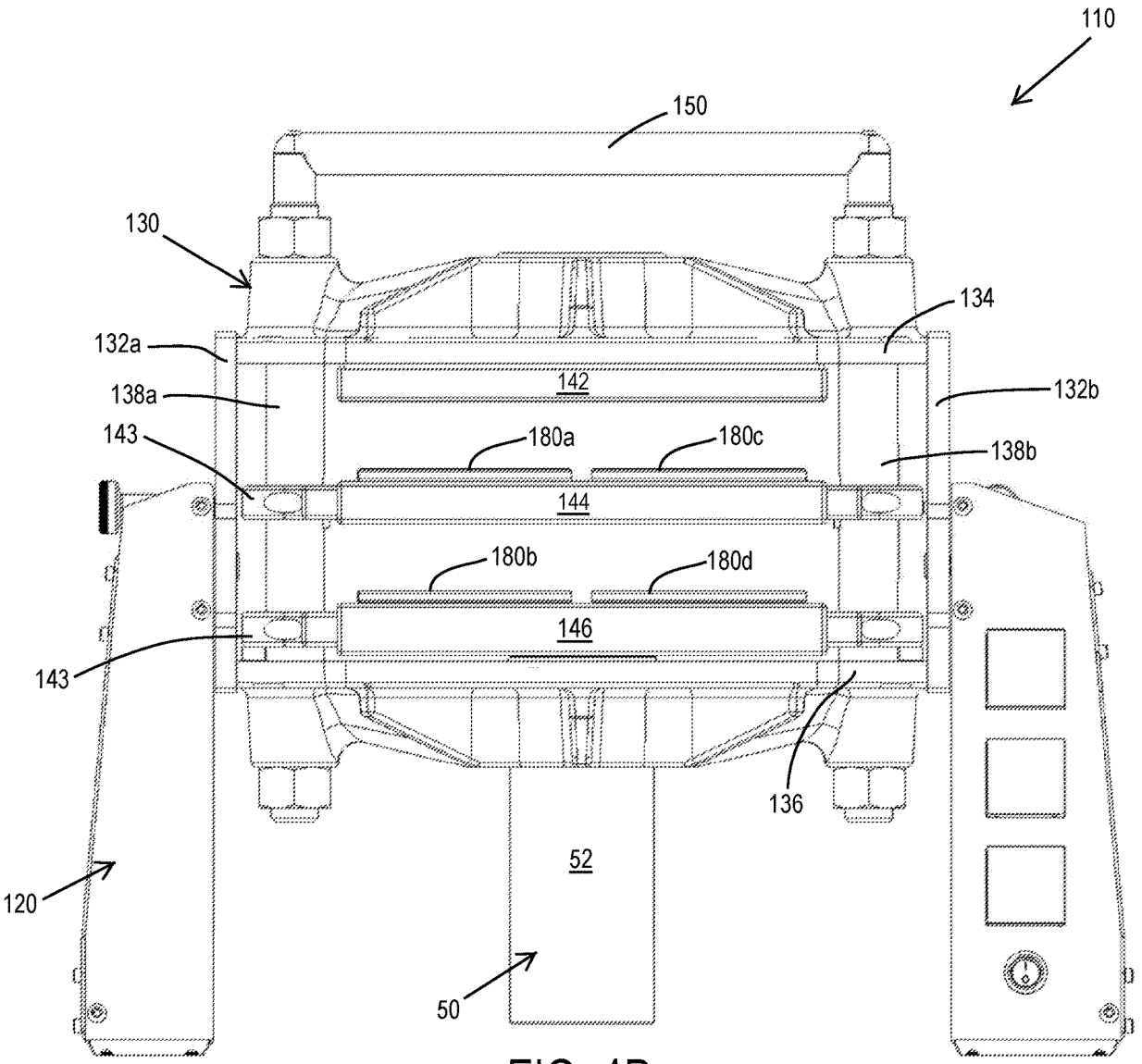
FIG. 4B illustrates a front view of the device of FIG. 4A in an open configuration.

FIGS. 4A and 4B illustrate another embodiment of a press device 110. The device 110 is composed of two primary assemblies: a press 130 and a stand 120. In the present embodiment the press 130 is configured in what may be termed an H-press design where opposing edges of plates/platens of the press 130 are supported. As shown, the press 130 includes side support brackets 132*a*, 132*b* (hereafter referred to 132 unless specifically referenced) that are connected to opposing edges of an upper plate 134, which connects to the upper ends of the brackets 132, and to opposing edges of a lower plate 136, which connects to the lower ends of the brackets 132. The plates 134, 136 are fixedly attached (e.g., bolted) to the brackets 132 such that the top plate 134 and bottom plate 136 are disposed in a spaced relationship. The press 130 is coupled to the stand via the brackets 132 to allow the plates of the press 130 to be rotated from a generally horizontal position to a vertical position as is more fully discussed below. The plates 134 and 136 are formed from metal and may be reinforced with various ribs such that they withstand significant expansion pressures applied between the plates during compression of plant material.

Figure 4C:
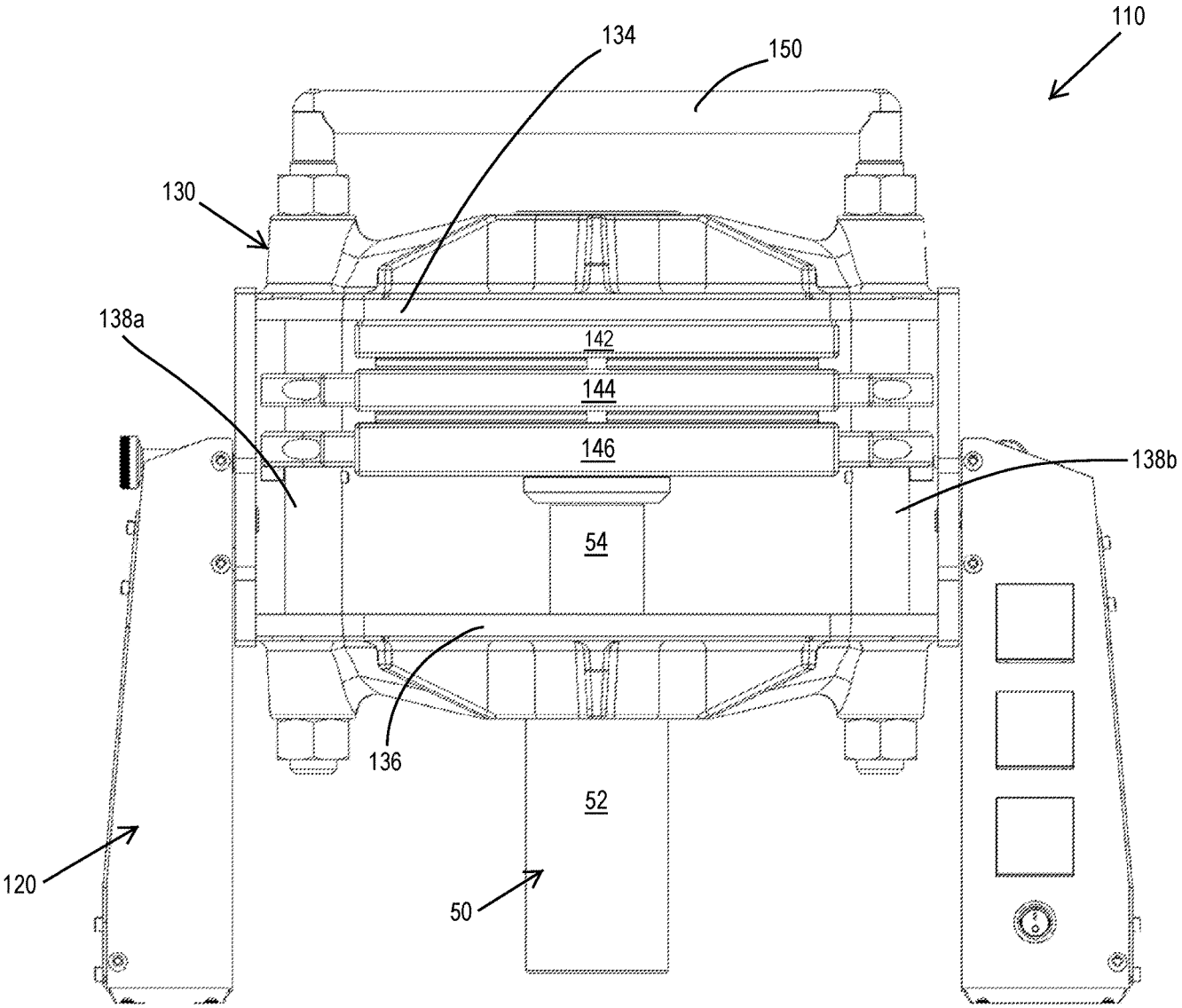
FIG. 4C illustrates a front view of the device of FIG. 4A in a closed configuration.

The present embodiment of the device 110 also includes two guide rods or shafts 138*a*, 138*b* (hereafter referred to 138 unless specifically referenced). The guide shafts are each connected to the upper plate 134 at an upper end and connected to the lower plate 136 at a lower end. The guide shafts 138 guide the linear motion of the movable platens. In this embodiment, the guide shafts are also tension rods that adding additional reinforcement of the upper and lower plates to expansionary forces. As illustrated, the shafts 138 are round linear motion shafts that extend through apertures in plates, 134, 136. Other embodiments contemplate shafts 138 with different cross-section profiles such as a square configuration and/or different guide structures. In any embodiment, the guide shafts 138 (or equivalent structure) engage one or more platens 144, 146, while allowing these platens 144, 146 to move along the length of the guide shafts 138. More specifically, in the present embodiment, an actuator (e.g., hydraulic ram 50) is operative to advance a movable lower platen 146 and a movable intermediate platen 144 against an upper platen 142. See. FIG. 4C. In the present embodiment, the upper platen 142 is fixedly mounted to the top plate 134 and thereby maintained in a fixed relation to the plates 134, 136 throughout a compression cycle.

To permit movement of the movable platens 144, 146, the linear guide shafts 138 interface with linear bearings 143 connected to opposing edges of these platens 144, 146. That is, a first set of linear bearings 143 are connected to the lower platen 146 and a second set of linear bearings 143 are connected to the intermediate platen 144. The linear bearings 143 slide relative to the shafts 138 in a direction parallel to the longitudinal axis of the shafts 138 allowing the intermediate platen 144 and the lower platen 146 to move axially between the lower plate 134 and the upper plate 134.

As noted, an actuator or ram 50 is operative to move the movable platens 144, 146 against the upper platen 142. The ram 50 is substantially similar to the ram described above in relation to FIGS. 1A and 1B. As above, a cylinder 52 of the ram 50 may be threaded and received in a threaded aperture in the bottom plate 136. A piston 54 of the ram 50 may controllably move in an upward direction relative to the bottom plate 136, extending toward the top plate 134. In operation, the piston 54 of the ram 50 extends upward and presses against a bottom surface of the lower platen 146 disposing the lower platen 146 toward the intermediate platen 144. Upon the lower platen 146 (or material positioned on the lower platen 146) contacting the intermediate platen 144, both platens are disposed upward toward an upper platen 142 (FIG. 4C). Before contacting the upper platen 142, the lower platen 146 and intermediate platen 144 move with relatively low resistance as guided by the linear bearings 143 moving up the guide shafts 138. Upon contacting the upper plate 142, the press will start building pressure in both platen interfaces (i.e., a first interface between the lower platen 146 and intermediate platen 144 and a second interface between the intermediate platen 144 and the upper platen 142).

FIGS. 4B and 4C illustrates a front view of the device 110. As shown, the platens 142, 144, 146 are disposed between the top plate 134 and the bottom plate 136. Each platen 142, 144, 146 maybe heated or cooled, independent of each other, in unison or any combination thereof. The lower platen 146 is disposed closest to the bottom plate 136. In an open or loading configuration (see FIG. 4B) the lower platen 146 rests on the bottom plate 136. In the present embodiment, the motion of the intermediate platen 144 is limited. More specifically, in the open configuration, the intermediate platen 144 may be limited in downward direction to a location approximately half-way between the lower plate/platen 136/146 and the upper plate/platen 134/142. The limited downward movement of the intermediate platen 144 in the open configuration creates two openings (i.e., a first opening between the lower platen 146 and intermediate platen 144 and a second opening between the intermediate platen 144 and upper platen 142) for loading material into the press 130. The downward movement of the intermediate platen 144 may limited by a set screw located in one or both of the shafts 138. However, other means for limiting the range of the intermediate platen 144 are possible.

Figure 4D:
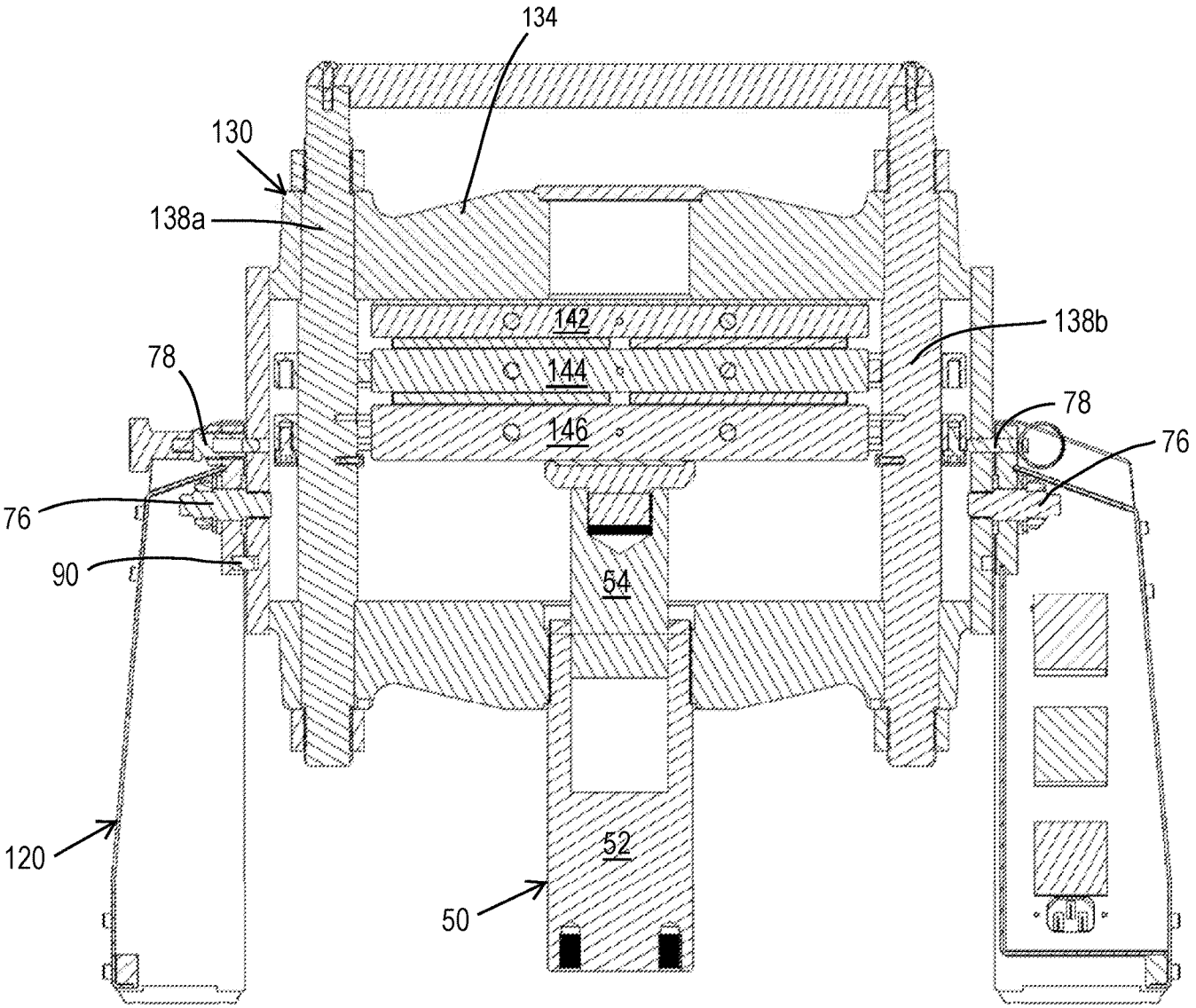
FIG. 4D illustrates a cons-sectional view of FIG. 4C.

As shown in FIG. 4B, while the press device 110 is in the open configuration, various prepared pucks 180*a-d* (hereafter 180 unless specifically referenced) of plant material may be positioned on the upper surfaces (e.g., compression surfaces) of the lower platen 146 and intermediate platen 144. The use of multiple platens increases the amount of product that may be processed during each compression cycle. Further, stacked alignment of the pucks (e.g., pucks 180*a*:180*b* and pucks 180*c*:180*d*) allows for compressing multiple pucks while decreasing the total area being compressed. That is, the total area under pressure in a closed configuration (see FIGS. 4C and 4D) is multiplied (i.e., area of first set of two puck and area of second set of two pucks), without increasing force on the ram 50 relative to a single platen configuration. For instance, if four pucks each having a surface area of 10 square inches were places on a single platen (e.g., in the device of FIG. 1A), the total area for compression would be 40 square inches. Compressing this area to an exemplary 500 psi would require 20,000 pounds force. In contrast, if the four pucks (each 10 square inches) pucks were aligned (e.g., effectively stacked) on the lower and intermediate platens as shown in FIGS. 4B and 4C, the total area under compression would be reduced to 20 square inches. Accordingly, compressing this area to 500 psi would only require 10,000 pounds force. Therefore the use of the device 110 having stacked platens allows for processing more product during a compression cycle while potentially reducing the force requirements of the actuator.

In further embodiments (not shown) the press 130 may have multiple intermediate platens 144 (e.g., two or more) arranged with various combinations of features discussed above. In this regard, each additional intermediate platen 144 results in adding an additional cavity for compressing additional material. Of note, adding an additional intermediate platen 144, further multiplies the area of compression without increasing the force on the ram.

As noted above, the brackets 132 connect the press 130 to the stand 120 while allowing the press 130 to be rotated from a generally horizontal position (e.g., see FIGS. 4C and 4D) to a generally vertical position. See FIGS. 5A and 5B. The stand 120 has a first set of legs 124*a* and a second set of legs 124*b* (hereafter referred to 124 unless specifically referenced). The legs 124 are connected to each of the brackets 132 via bearings/journals such that the press 130 is disposed between the first set of legs 124*a* and the second set of legs 124*b*. See FIG. 4A. In this embodiment the area below the press 130 is left open to allow a collection device such as a cooled plate to be inserted below the press 130. As shown in the present embodiment, the legs 124, each are shaped in an upside-down v-configuration and each have two points of contact with a surface below to stably support the press 130. However, other support means are possible including, without limitation different leg configurations, supports stands, and/or the like. In any arrangement, the press 130 is configured to interface with the stand 120 to allow the press to rotate relative to the stand such that the upper plates 134, the lower plates 136 and platens 142, 144, 146 can move from a horizontal orientation to a vertical orientation.

Figure 5A:
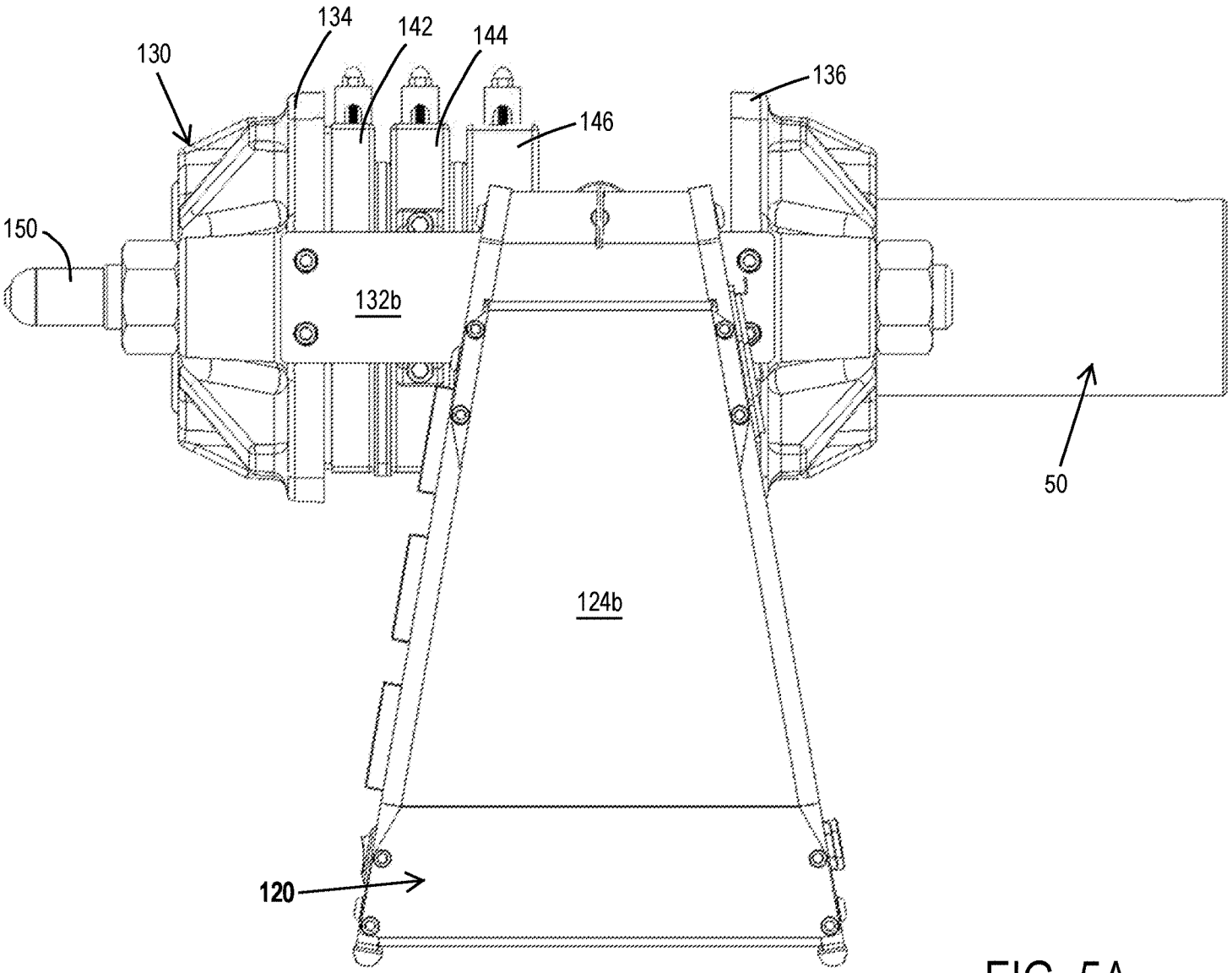
FIG. 5A illustrates a side view of the device of FIG. 4A a vertical orientation.
Figure 5B:
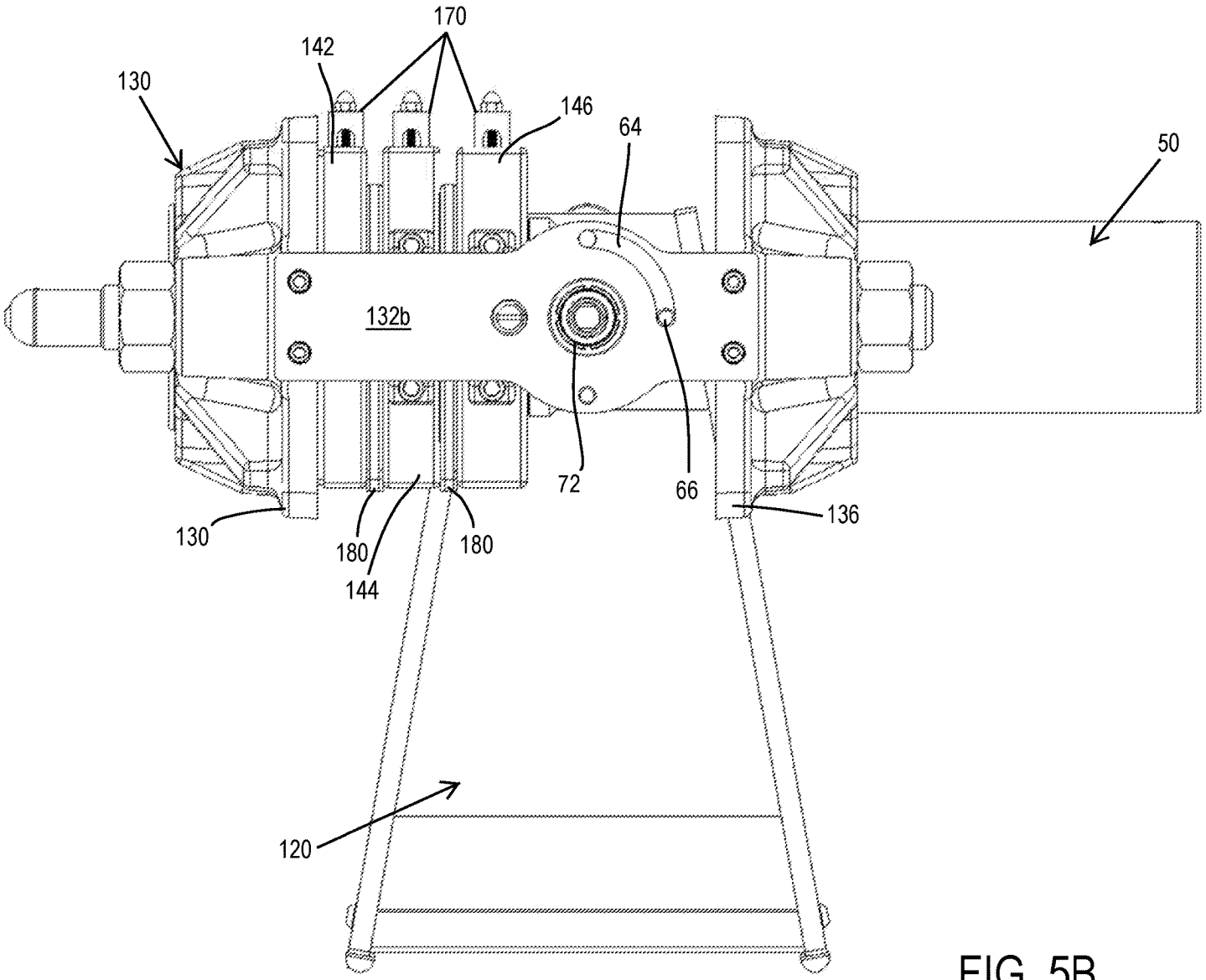
FIG. 5B illustrates another side view of the device of FIG. 4A a vertical orientation

FIGS. 5A and 5B illustrate the device in a horizontal orientation. More specifically FIG. 5A shows a rear view of FIG. 4A and FIG. 5B illustrates FIG. 5B with a leg removed for purposes of illustration. As best shown in FIG. 5B, the bracket 132 includes a bearing 72 that receives a journal or other shaft (see FIG. 4D) attached to the leg to permit the press 130 to rotate relative to the stand 120. In the present embodiment, the rotation of the brackets, and thus, the rotation of the press 130 is limited to 90°. Although other degrees of rotation are contemplated. Limiting the rotation of the press 130 is accomplished by pin 66 attached to the leg (not shown) that is received within an arcuate guide slot 66 slot formed in the bracket 132. The reverse configuration—pin in the brackets and guide slot in the legs—is also contemplated. Other embodiments can include other means for limiting the rotation of the press 130 in relation to the stand 120 including, without limitation a tab on one or more of the legs 124 that extends outward to engage a side of the bracket 132 and maintain the press 130 at a desired rotational position. In addition, the stand 120 and press may have various plungers 78 and or spring loaded balls/detents 90 that maintain and/or lock the press in a desired orientation.

Of note, positioning of the brackets 132 on the side edges of the plates 134, 136, results in the press 130 having an open front and back that allows material to drip out of the press 130 when the plates/platens are rotated into the vertical orientation. Operation of the device 110 to extract plant rosin includes the following steps. The plant material is prepressed with a mold kit, as described above, to produce partially compacted pucks 180 of material to be processed by the device 110. A first puck or set of pucks 180*b*, 180*d* are then positioned between the lower platen 146 and the intermediate platen 144. See FIG. 4B. A second puck or second set of puck 180*a*, 180*c* are positioned between the intermediate platen 144 and the upper platen 142. The piston 54 is then advanced to push the lower platen 146 toward the intermediate platen 144. See. FIG. 4C. Upon the first set of pucks contacting a bottom surface of the intermediate platen 144, both platens 146, 144 and the puck are advanced by the piston 54 toward the upper platen 142. The piston 54 advances the platens 146, 144 until the second set of pucks (located between the intermediate platen 144 and the upper platen 142) contacts the upper platen 142. At this point the compression force may be maintained at a relatively low level compared the subsequent extraction compression procedure. That is, prior to rotating the press 130 into a vertical position the compression force is maintained at a level that will hold the pucks between the platens 142, 144, 146 while rotating the press 130 to a vertical orientation, but without extracting any rosin/fluid from the puck (or minimizing any extraction at this point). The press 130 is now in the compressing configuration and a user may grasp the handle 150 and rotate the press 130 to the horizontal orientation. See FIGS. 5A and 5B, which illustrate the press 130 in a compressing configuration.

After the press has been rotated 90° from a horizontal orientation to a vertical orientation the extraction compression procedure may be completed. That is, once the platens 142, 144, 146 are vertically oriented and the extraction pressing procedure may be completed. Specifically, the platens are compressed by the ram 50 driving the piston 54 against the lower platen 146, which translates the force generated by the ram 50 through all of the platens until a desired pressure is achieved between the platens. When the platens 142, 144, 146 are compressed together to the desires pressure, liquid rosin is expelled rosin from the plant material. The liquid falls below the press 130 into the open area between the legs 124. A plate, which may be cooled, is placed between the legs 124, under the press 130, to catch the expelled liquid.

Figure 6A:
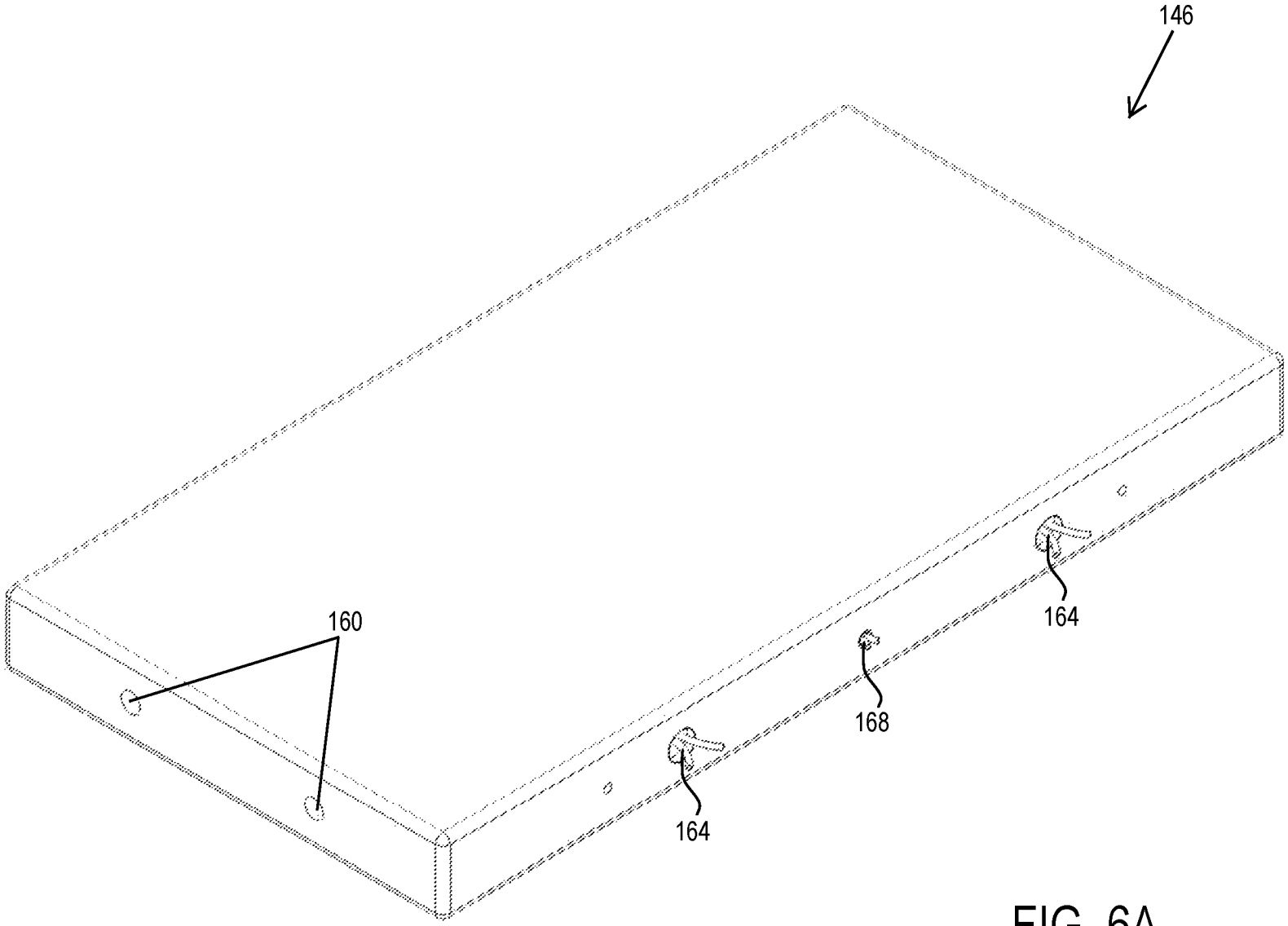
FIG. 6A illustrates a perspective view of a heated platen.
Figure 6B:
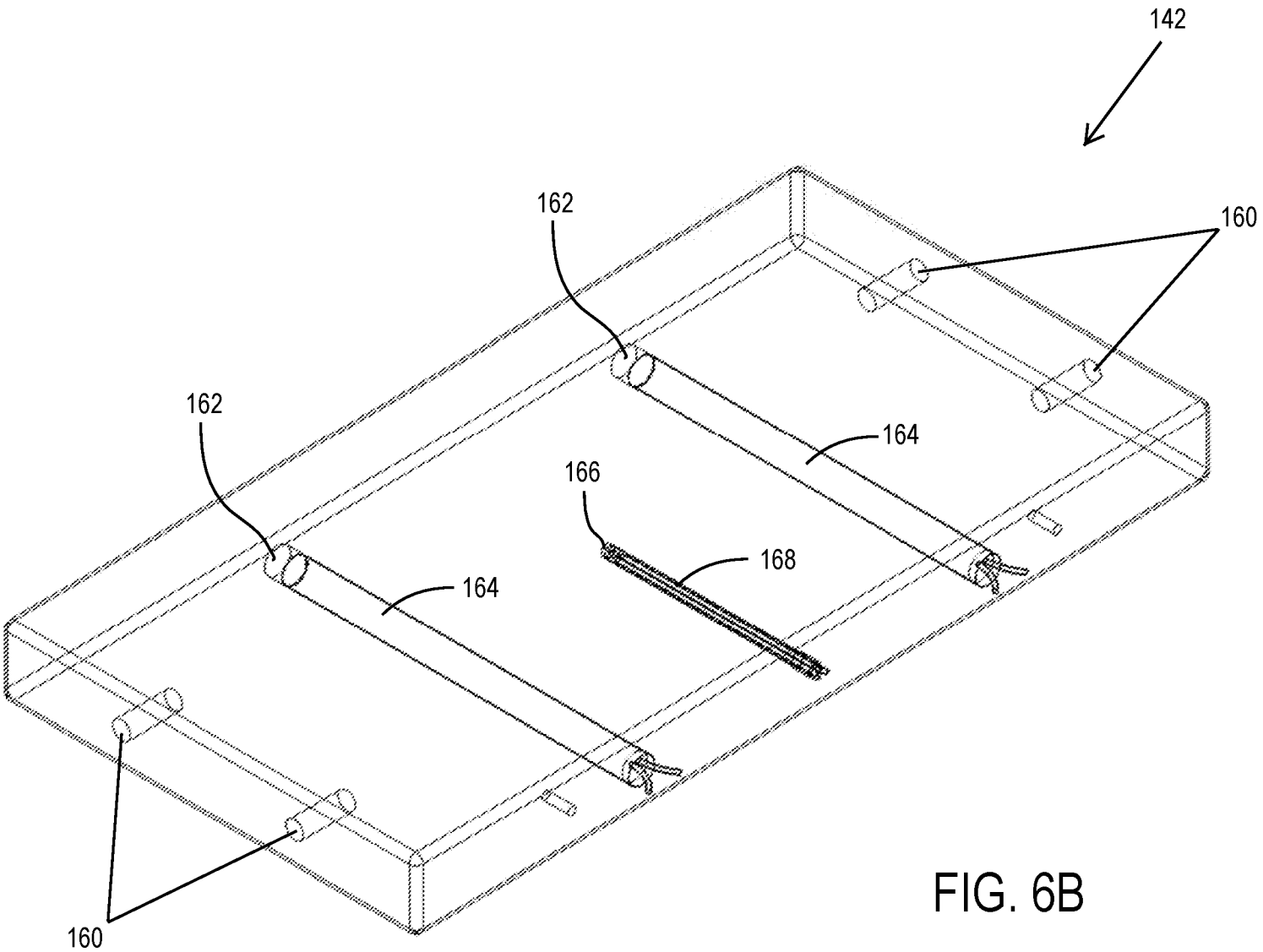
FIG. 6B illustrates a partially transparent view of FIG. 6A.

As previously noted, any or all of the platens may be heated to facilitate the removal of extracts from the compressed plant material. FIGS. 6A and 6B illustrate the lower platen 146 and one embodiment of heaters disposed therein. Though discussed in relation to the lower platen 146, it will be appreciated that the following discussion is applicable to any of the above discussed platens. As shown, the exemplary platen 146 is generally defined as a rectangular prism having a generally rectangular upper and lower surface. One or both of these surfaces may form a compressing surface when attached to a press. Typically, the platen 146 is formed from a metal or metal alloy to allow the platen to withstand high compression pressures and to allow the platen to effectively conduct heat. The illustrated platen 146 includes apertures 160, which in the embodiment of FIGS. 4A-5B, connect with the linear brackets. The platen 146 also includes two cylindrical recesses 162 extending through an edge surface of the platen 146 into an interior of the platen. The cylindrical recesses 162 are, in the present embodiment, sized to receive cylindrical cartridge heaters 164. The cartridge heaters 164 are electrically connectable to a power source (not shown) and are operative to heat the platen 146 to a desired temperature. The heaters 164 may be fixedly attached within the platen using one or more clamps 170. See, e.g., FIG. 5B. Such cylindrical cartridge heaters are well known and may be sized to provide a desired level of heating for the platen. Though illustrated as utilizing cylindrical cartridge heaters, it will be appreciated that any heating element that provides thermal energy to the plant may be utilized.

To control the operation of the heaters 164, the platen 146 further includes a cylindrical thermocouple recess 166, which houses a thermocouple 168. The thermocouple 168 generates an output indicative of the temperature of the platen 146. This output may be received by a control panel 182 of the device 110, which may include a temperature control. Accordingly, a user may adjust the temperature of the platens. Along these lines, it will be noted that different plant materials may require different temperatures for effective processing. Though discussed as utilizing a thermocouple, it will be appreciated that any heat sensor may be utilized.

Variations may be made to the presented device. For instance, various sensors (e.g., weight sensors) may be incorporated into the collection plate to determine when fluid/rosin ceases dripping onto the plate. Accordingly, an output (e.g., alarm) may sound alerting a user that extraction is complete. Further, various control systems and motors may be incorporated to allow for automated operation of the device. In such an arrangement, after a user loads a puck into the device, the user may simply start the device and the initial compression, rotation secondary compression and collection of resin may proceed automatically.

The foregoing description has been presented for purposes of illustration and description. Furthermore, the description is not intended to limit the inventions and/or aspects of the inventions to the forms disclosed herein. Consequently, variations and modifications commensurate with the above teachings, and skill and knowledge of the relevant art, are within the scope of the presented inventions. The embodiments described hereinabove are further intended to explain best modes known of practicing the inventions and to enable others skilled in the art to utilize the inventions in such, or other embodiments and with various modifications required by the particular application(s) or use(s) of the presented inventions. It is intended that the appended claims be construed to include alternative embodiments to the extent permitted by the prior art.

What is claimed is:

1. A compression device for extracting materials from plant matter, comprising:

a press having:

first and second plates disposed in a spaced relationship;

a stationary platen mounted to the first plate, the stationary platen further including at least one heating element;

a first movable platen disposed proximate to the second plate when the press is in an open configuration, the first movable platen including at least one heating element;

a second movable platen disposed between the first movable platen and the stationary platen, the second movable platen including at least one heating element; and an actuator connected to the first movable platen and configured to advance the first moveable platen toward the stationary platen; and a stand suspending the press, wherein the stand connects to the press via a rotary coupling configured to permit the press to rotate between:

a first orientation where compression surfaces of the platens are disposed in a horizontal orientation; and a second orientation where the compression surfaces of the platens are disposed in a vertical orientation.

2. The device of claim 1, further comprising:

a guide shaft extending between the first and second plates.

3. The device of claim 2, wherein the first movable platen and the second movable platen each further include:

a linear bearing, wherein the linear bearing is attached to the guide shaft.

4. The device of claim 1, wherein the actuator comprises:

a hydraulic cylinder and piston, wherein the piston contacts the first movable platen.

5. The device of claim 4, wherein the hydraulic cylinder is attached to the second plate.

6. The device of claim 1, wherein advancement of the first moveable platen toward the stationary platen compresses the second movable platen between the first movable platen and the stationary platen.

7. The device of claim 1, wherein the actuator advances the first movable platen in a linear direction.

8. The device of claim 1, further comprising:

at least a first temperature sensor connected to at least one of the platens.

9. The device of claim 1, further comprising:

first and second brackets, wherein first ends of the brackets are connected to opposing edges of the first plate and second ends of the brackets are connected to opposing edges of the second plate.

10. The device of claim 8, wherein the first and second brackets are connected to the stand via a first and second rotary couplings, respectively.

* * * * *